United States Patent [19]

Szegvari

[11] 4,244,531

[45] Jan. 13, 1981

[54] AGITATED-MEDIA MILL WITH A BAFFLED INNER WALL

[75] Inventor: Andrew Szegvari, Akron, Ohio

[73] Assignee: Union Process, Inc., Akron, Ohio

[21] Appl. No.: 956,341

[22] Filed: Oct. 31, 1978

[51] Int. Cl.[3] ..... B02C 17/16

[52] U.S. Cl. ..... 241/172

[58] Field of Search ..... 241/26, 46.11, 46.17, 241/172; 366/307, 325, 605

[56] References Cited

U.S. PATENT DOCUMENTS

| | | | |
|---|---|---|---|
| 975,380 | 11/1910 | Bernston | 366/307 X |
| 2,779,752 | 1/1957 | Vining | 241/172 X |
| 3,332,628 | 7/1967 | Wadham | 241/172 X |
| 3,404,870 | 10/1968 | Multer | 366/307 |
| 3,601,322 | 8/1971 | Szegvari | 241/172 X |

FOREIGN PATENT DOCUMENTS

| | | | |
|---|---|---|---|
| 911427 | 10/1972 | Canada | 366/307 |
| 667333 | 10/1938 | Fed. Rep. of Germany | 241/172 |

*Primary Examiner*—Mark Rosenbaum

*Attorney, Agent, or Firm*—Reed, Smith, Shaw & McClay

[57] ABSTRACT

An agitated-media mill of the batch, circulation, or continuous types in which the elements of a comminuting media randomly interact in response to an agitator having motion relative to the comminuting media to comminute the process mixture. In one embodiment the agitated-media mill includes a baffle adjacent the inner wall of the comminuting vessel and arranged transversely with respect to the flow of the process mixture. The baffle redirects the comminuting elements to increase the random interaction of the elements throughout the vessel and also opposes the solid body rotation of the process mixture to provide improved comminution of the mixture. The cross-sectional shape and general configuration of the baffle is chosen with respect to, the particular type and application of the agitated-media will aid in complete comminution of the process mixture and to retard accumulation of particles on the baffle and adjacent surfaces. A plurality of baffles can be located at various circumferential locations about the vessel, and can be permanently or removably attached to the vessel inner wall. In another embodiment, the radial members of the agitator are non-circular and are disposed to operate as baffles that establish vertically oscillating flow of the mixture to increase the random interaction of the elements and improve comminution of the mixture.

10 Claims, 14 Drawing Figures

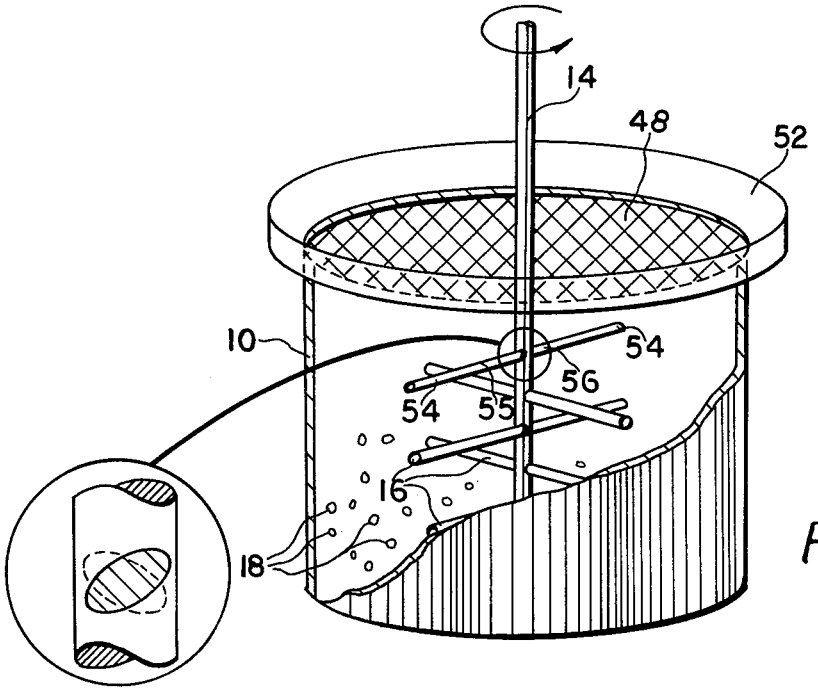
FIG 11
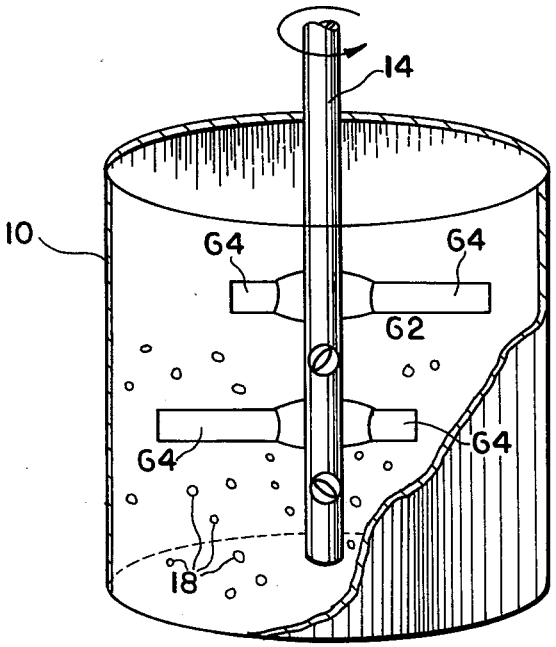
FIG 14
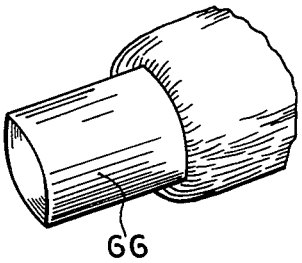

AGITATED-MEDIA MILL WITH A BAFFLED INNER WALL

BACKGROUND OF THE INVENTION

1. Field of the Invention

The present invention relates to methods and apparatus for comminuting a process mixture and, more particularly, to methods and apparatus for comminuting a process mixture in an agitated media.

2. Description of the Prior Art

Various methods and apparatus have been used to grind particulate solids. These include ball mills, pebble mills, roll mills, send mills, and tube mills. Considered to be generally illustrative of this art are U.S. Pat. Nos. 1,577,052; 1,956,293; 2,903,191; 3,131,875; 3,298,618; 3,329,348; 3,337,140; 3,339,896; 3,432,109; 3,591,349; and 3,628,956; and British Pat. No. 1,038,153.

Distinguished from the above apparatus and methods used for grinding are comminuting devices and methods. As used herein, comminuting is specifically defined to include dispersion and deflocculation processes in addition to grinding processes. Attendant advantages of the comminuting type mill are the capacity for simultaneously mixing two or more different solids, or for suspending one or more particulate solids in a liquid.

Prior art comminuting apparatus and methods which have been found to be particularly effective have included agitated-media comminuting apparatus. Such comminuting means generally include a vessel that contains a bed of comminuting elements that are agitated by members connected to a rotating shaft. Typically, the solid particles are ground to a particle size in the range of 50 to 0.5 microns and, in certain instances, the particles are ground even smaller. A substantial advantage of the agitated media type comminuting mills, as compared to vibratory mills for example, is that comminution occurs primarily between the comminuting elements of the agitated media and does not involve the vessel walls. Consequently, mechanical wear of the agitator shaft and the inner wall of the vessel is considerably reduced. Another advantage of agitated-media type comminuting mills is that the comminuting vessel remains stationary so that these mills are less cumbersome than vibratory type mills. Examples of agitated-media mills are discussed in U.S. Pat. Nos. 2,764,359; 3,008,657, 3,075,710; 3,149,789; and 3,539,117; British Pat. Nos. 716,316, 1,331,662; and German Patentschrift Nos. 1,214,516; and 1,233,237.

Generally, agitated-media comminuting mills are described as batch-type, circulation-type, or continuous-type mills. In a batch-type mill such as described in U.S. Pat. No. 2,764,359, a selected quantity of a process mixture is placed in a vessel together with the comminuting media and the comminuting media is then agitated by an agitator. The properties of the process mixture are such that, as a general rule, the mixture behaves as a fluid. Generally the process mixture includes a liquid that tends to hold the solid particles in suspension as they are being comminuted with the solids in the suspension comprising 20–50% by volume and 40–65% by weight. Alternatively however, the process mixture may be substantially comprised of one or more kinds of solid particles that are to be comminuted. In the case of comminuting particulate solids where no liquid is present, the agitated-media mill generally includes two agitators. These agitators have substantially parallel shafts that are laterally disposed. The comminuting media is agitated until the mixture is ground, dispersed and/or deflocculated as required. When the mixture is sufficiently comminuted, the batch type comminuting mill is stopped and the processed comminuted material is removed.

The continuous-type agitated-media comminuting mill such as described in U.S. Pat. No. 3,149,789 is somewhat similar to the batch-type mill except that the mill is more elongated and the process mixture is steadily introduced to the comminuting vessel at one end and the comminuted mixture is removed at the opposite end. Usually, the mixture is introduced at the bottom of the vessel and removed from the top of the vessel with the verticle progression of the mixture through the vessel being horizontally stratified such that the particle density and size distribution of the mixture remain substantially the same at each level of the vessel.

In circulation-type agitated-media comminuting mills such as described in U.S. Pat. No. 3,998,938, the comminuting vessel is somewhat similar to that of the batch-type mill but the process mixture is repeatedly recirculated at a high flow rate through the comminuting vessel as the mixture is being comminuted. The high flow rate, sometimes referred to as "streaming speed", together with the recirculation of mixture results in an unexpectedly rapid comminution of the mixture and provides a product with a narrow particulate size distribution. The streaming speed is generally measured in terms of the volume of the agitated-media comminuting mill which is defined as the difference between the volume of the comminuting vessel and the volume displaced by the agitator together with the comminuting media. Typically the volume of the agitated-media mill is in the range of about 35 to 50 percent of the total volume of the comminuting vessel. Also typically the streaming speed is at least about 30 and preferably between 50 and 300 volumes per hour.

It is believed that the improved comminuting performance of the batch, continuous, and circulation agitated-media mills is due to the action of the agitated media and, in particular, to the collisions between the comminuting elements. These collisions impinge on the solid particles of the process mixture causing the particles to be physically divided and sub-divided. Furthermore, it appears that, in certain instances, changes in the properties of the particle solids also occurs. This action of the agitated media has been variously described in connection with the kinetic energy of the comminuting elements and the mean free path between collisions of the comminuting elements. Indeed the comminuting elements used in agitated-media comminuting mills are generally smaller than those employed in other types of mills in order to increase the rate of collisions between comminuting elements and, thereby, increase the rate of comminution.

In circulation comminuting mills where vertical flow of the process mixture is substantial, the additional factor of streaming speed appears to have a further effect on the rate of comminution. The circulation-type mills comminute the particles in the process mixture at a rate that is unexpectedly higher than the rate of processing that is obtained with considerably larger batch-type agitated-media mills. The higher the streaming speed, the higher the frequency that any given volume of the process mixture passes through the agitated-media mill and the faster the mixture is comminuted. In the circulation-type comminuting mills, an additional factor in the improved comminuting results is believed to be a dynamic screening effect in which the agitated media acts as an effective screen that tends to retain the larger, less comminuted particles in the comminuting mill until they are comminuted by the agitated media. Accordingly, a circulation-type agitated-media mill has a higher processing capacity than batch-type and continuous-type mills of comparable size and capacity.

As another result that is apparently due to the dynamic screening action of the agitated media in the circulation-type comminuting mill, it has also been found that additional, ingredients can be intermittently or continuously added to the process mixture during the operation of the circulation-type agitated-media comminuting mill to disperse the additional ingredients throughout the mixture such that the comminuted product includes ingredients and/or proportions having controlled particle sizes and/or chemical or physical properties.

In many applications, agitated-media comminuting mills of the prior art have proven effective for certain applications for comminuting the process mixture to provide a product having small particle size of substantially uniform size distribution. Examples of process mixtures that have been thus comminuted are ferromagnetic materials, paint pigments, dye pigments, tungsten carbide, certain carbon blacks and transparent oxides. However, in agitated-media comminuting mills of the prior art, whether of the batch, circulation, or continuous type, it has now been found that, where there is substantially no random motion of the comminuting elements, there is substantially no comminution of the material to be processed. Moreover, it has also been found that where there is insufficient relative motion between the comminuting elements and the agitator, there is again substantially no comminution of the mixture. This condition does not appear to be dependent upon whether the mixture includes a suspension liquid but, rather, upon the degree of random motion of comminuting elements and upon the fluid properties of the mixture. Specifically, it is believed that the condition of insufficient random motion of the comminuting elements is related to the kinetic condition of the grinding media. Also, it is believed that the condition of insufficient motion of the agitator with respect to the agitated media is related to the tendency of the process mixture to rotate as a solid with the agitator due to the viscous properties of the mixture and the surface friction of the inner wall of the comminuting vessel. More specifically, it is believed that when these properties and conditions establish a laminar flow condition in the boundary layer of the mixture, there is an insufficient friction against the rotation of the mixture. Consequently, the mixture tends to rotate as a solid body with the agitator and there is insufficient mutual action between the comminuting elements and the agitator. As used herein, boundary layer is specifically defined to mean the layer of mixture adjacent the surface of the inner wall of the comminuting vessel.

The tendency of the mixture to rotate with the agitator as a solid mass has been found to be particularly prevalent among certain particulate materials that tend to flocculate together as a single amorphous mass. Common examples in which there is substantially no random motion of the comminuting elements or there is insufficient relative motion between the comminuting media and the agitator are found in applications where a mixture, while not necessarily having a substantial tendency to flocculate before comminution is begun, undergoes a change in its properties during comminution such that the rate of reflocculation increases to the extent that the partially comminuted mixture rotates with the agitator as a solid. For example, in grinding aluminum powder into a fine aluminum dispersion suitable for the manufacture of aluminum paint and related materials, the aluminum powder granules have been found to have a tendency to reflocculate such that they tend to rotate with the agitator as a single mass. As another example, chocolate has also been found to exhibit this tendency for reflocculation-especially under conditions of high moisture content (e.g. in the range of 3–6% by weight).

Prior to the present invention, a need existed for a method and structure for establishing random motion of the comminuting elements, and for opposing the tendency of certain process mixtures to rotate as a solid with the agitator thereby establishing relative motion between the agitator and the comminuting media to comminute the mixture to be processed. Various liners and coatings have been used in tube mills, ball mills, and other grinding mills known to the prior art. Examples are found in U.S. Pat. Nos. 3,202,364; 2,909,335; 1,741,604; 1,307,952; 2,334,256; 639,409; B441,416; and 1,986,103. However, none of these devices were suitable for use in an agitated media comminuting mill as described above such that they would be effective either to establish random motion of the comminuting elements or to prevent the solid body rotation of the mixture in order to comminute the mixture. Accordingly, there was a need for a method and apparatus for establishing random motion of the comminuting elements, and for preventing solid body rotation of the process mixture in agitated media comminuting mills.

SUMMARY OF THE INVENTION

In accordance with the present invention for comminuting particulate solids, a comminuting mill includes a comminuting vessel and an agitator having a rotatable shaft that extends into the vessel. The rotatable shaft has radial members such as arms or discs, extending from the shaft. The comminuting mill also includes a comminuting media that is within the vessel and that overlies at least some of the radial members at times when the agitator has no angular rotation with respect to the vessel. The comminuting mill is further provided with at least one means for redirecting a portion of the comminuting media to increase random action of the comminuting media.

Preferably, the baffle is attached to an inner wall of the vessel and disposed transversely to the flow of the mixture and extending radially inward to a position adjacent the distal portions of the radial members.

In response to the rotation of the agitator shaft, the baffle cooperates with the comminuting media as impelled by the agitator to redirect some of the comminuting media radially within the comminuting vessel such that the random motion of the comminuting elements is increased and the comminution improved. Also in response to the rotation of the agitator shaft, the baffle opposes solid body rotation of the process mixture to establish relative motion between the comminuting media and the agitator such that the agitated media comminute the mixture. Preferably, the flow is such that it aids complete comminution of the process mixture and retards accumulation of particles on the baffle and adjacent surfaces.

Also preferably, the baffle member is provided with a plurality of holes that streamline the flow of the mixture and that retard the accumulation of particles on the baffle and adjacent surfaces.

Also, the baffle member can be a plurality of longitudinally arranged baffle sections or, alternatively, can include protuberances that extend radially toward the agitator.

Preferably, the apparatus is further provided with a means for circulating the mixture vertically through the comminuting vessel from an input port to an output port. In this case, it is preferred that the baffle member be in the general shape of a helix that is attached to the inner wall of the vessel.

Alternatively, the portion of the agitated media is redirected by a non-circular agitator arm of the agitator such that the random motion of the comminuting elements is increased and the comminution improved.

Other details, objects and advantages of the invention will become apparent as the following description of certain presently preferred embodiments thereof and presently preferred methods of practicing the same proceed.

BRIEF DESCRIPTIONS OF THE DRAWINGS

The accompanying drawings show certain presently preferred embodiments of the invention and illustrate certain presently preferred methods of practicing the same in which:

FIG. 11 shows a circulation-type comminuting mill with a portion of the vessel broken away to show a modification of the agitator for directing the comminuting elements away from the top of the mill.

FIG. 14 shows a batch-type comminuting mill with a portion of the vessel broken away to show a baffled agitator that tends to increase the random motion of the comminuting media.

DESCRIPTION OF THE PREFERRED EMBODIMENT

In accordance with the preferred embodiment shown in FIG. 1, a batch-type agitated-media comminuting mill includes a comminuting vessel 10, a portion of which is broken away to show the internal structure of the mill as hereinafter described. Although comminuting vessel 10 is substantially a right circular cylinder, vessels having other geometries, such as an inverted cone, can also be used and are preferred for certain application.

An agitator 12 has a rotatable shaft 14 that extends into comminuting vessel 10. As shown FIG. 1, the longitudinal axis of shaft 14 is substantially aligned with the vertical central axis of comminuting vessel 10. However, shaft 14 can also be otherwise disposed within vessel 10. Agitator 12 is further provided with a plurality of radial members that extend from shaft 14. Preferably, the radial members comprise agitator arms 16 that are perpendicular to agitator shaft 14. Also preferably, agitator arms 16 are of substantially uniform length and have substantially even vertical distribution along agitator shaft 14. As shown in FIGS. 1–13 arms 16 have a circular cross-sectional shape. However, arms with other cross-sectional shapes can also be used. For example, as subsequently described in relation to FIG. 14, arms 16 can have an elliptical cross-section with the major axis of the ellipse in a horizontal plane that is perpendicular to shaft 14 or, alternatively, at a slight angle with respect to the horizonal plane. As subsequently explained, this shape tends to further increase the hydrodynamic effect of the agitator on the process mixture at a given angular velocity of the agitator.

Preferably, vertically adjacent agitator arms are arranged at a selected radial angle in the range of about 2.5 to 90 degrees with respect to each other. The preferred angle varies with particular applications. For example, in batch-type comminuting mills, it is preferred that longitudinally adjacent arms are at an angle of about 2.5 degrees on one side and about 60 degrees on the other side. In the continuous-type comminuting mills, it is preferred that longitudinally adjacent arms are at an angle of about 45 degrees on one side and about 90 degrees on the other side. In the circulation-type comminuting mills, it is preferred that longitudinally adjacent arms are at an angle of about 90 degrees on either side. For each type of comminuting mill, the respective angular arrangement of arms 16 has been found to advantageously increase the hydrodynamic effect of the agitator on the process mixture.

Figure 1:
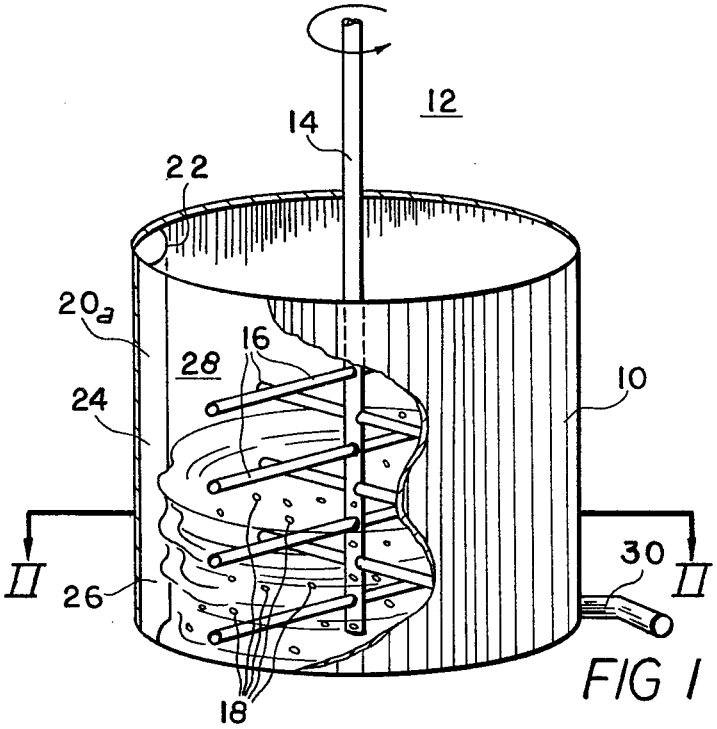
FIG. 1 is a perspective view of a batch-type agitated-media comminuting mill in which a portion of the comminuting vessel has been broken away to show the baffle member affixed to the vessel inner wall.

The agitated-media comminuting mill of FIG. 1 further includes a comminuting media comprised of a multiple of comminuting elements 18 such as pebbles, or ceramic or metal balls. Preferably, comminuting elements 18 are spherical in shape and generally have a diameter in the range of about 9/16 inch (1.42 cm) to ⅛ inch (3.17 mm) although smaller or larger comminuting elements may also be used depending on the viscosity of the process mixture, the rated angular velocity of agitator shaft 14, and the size of comminuting vessel 100 and agitator 12 as well as other variable parameters. Comminuting elements 18 are of a substantially common diameter and may be composed of steel, tungsten carbide, ceramics, or other material. The comminuting media includes a sufficient number of comminuting elements 18 such that, at times when agitator 12 is stationary and comminuting elements 18 are in an unagitated state, the volume of the comminuting media is sufficient that the comminuting elements 18 cover at least one of agitator arms 16. Greater numbers of comminuting elements 18 may also be used as, for example, where there are sufficient comminuting elements to cover the uppermost agitator arm 16 when the comminuting media is in an unagitated state. The most preferred number of comminuting elements depends on various parameters including the viscosity of the comminuting media; the size, density, and shape of the comminuting elements; and the rated angular velocity of the agitator. Preferably, the vertical separation between vertically adjacent agitator arms 16 is in the range of two to four times the diameter of comminuting elements 18 although this also is variable depending upon the particular application.

Figure 2:
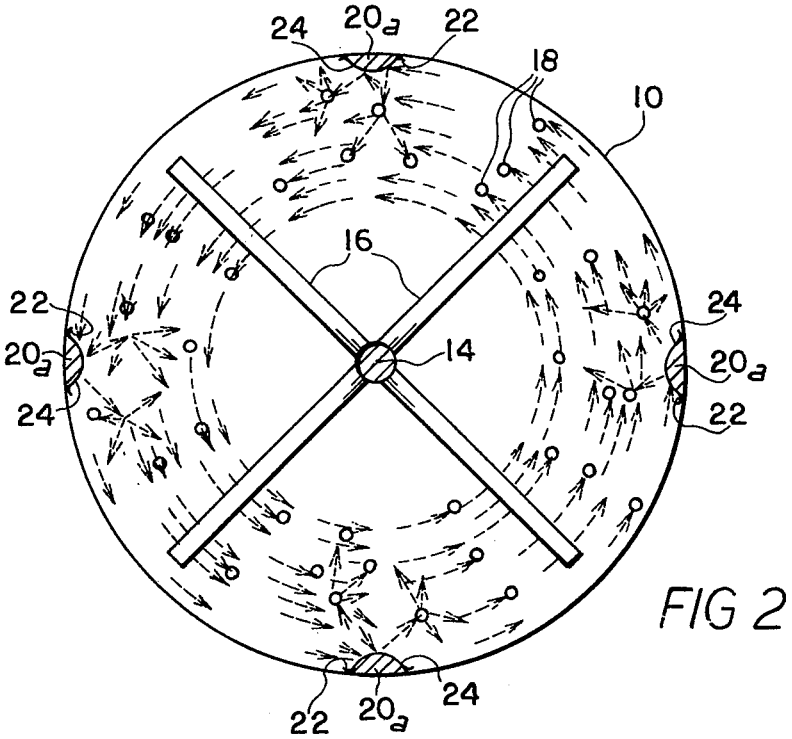
FIG. 2 is a cross-sectional view taken along the lines II—II of FIG. 1 to illustrate the cooperation of the baffle member with the agitated media in redirecting the agitated media and in opposing the solid body rotation of the process mixture.

The disclosed comminuting mill of FIG. 1 further includes a baffle member 20*a* that extends radially inward from the inner wall of comminuting vessel 10 to a position adjacent the distal portions of agitator arms 16. As shown in FIGS. 1 and 2, baffle member 20*a* has a first surface 22, herein referred to as a redirecting face, and a second surface 24, herein referred to as a streamlining face. Baffle member 20*a* is fastened to the inner wall of comminuting vessel 10 such that it is parallel adjacent to the inner surface of the vessel wall and longitudinally extends between a lower region 26 and an upper region 28 of the comminuting vessel. Baffle member 20*a* is oriented within the vessel such that redirecting face 22 and streamlining face 24 are open to the interior of the vessel. Preferably, redirecting face 22 and streamlining face 24 are contoured such that the intersection of redirecting face 22 with streamlining face 24 is contained in a continuous surface. Also preferably, redirecting face 22 and streamlining face 24 are contoured such that the intersections of redirecting face 22 and streamlining face 24 with the inner wall of comminuting vessel 10 are respectively contained in substantially continous surfaces. Baffle member 20*a* has an inward extension such that the radial distance between the innermost surface of baffle member 20*a* and the distal ends of agitator arms 16 is sufficiently large to prevent jamming of the agitated-media therebetween. Generally, this has been found to be in the range of two to four times the diameter of comminuting elements 18. However, this radial distance may be greater or lesser depending on the particular application and on the rated angular velocity of shaft 14. The radial dimension of baffle member 20 is limited by its longitudinal dimension in the sense that the radial dimension is less than the longitudinal dimension for all applications.

Comminuting vessel 10 may also be provided with a water of steam jacket (not shown) for temperature control of the vessel contents, and is provided with an output port 30 through which the comminuted process mixture is removed after comminution is completed. Output port 30 is provided with a screen or other suitable means for separating comminuting elements 18 from the comminuted process mixture. Alternatively, comminuting elements 18 may be removed from comminuting vessel 10 together with the comminuted process mixture and subsequently separated therefrom.

In the operation of the embodiment of FIG. 1, a volume of process mixture is placed in comminuting vessel 10. Agitator shaft 14 is then rotated at a sufficient angular velocity such that, when sufficient rotation of agitator arms 16 with respect to comminuting elements 18 is established, kinetic energy is imparted to comminuting elements 18 from agitator arms 16 to agitate or excite the comminuting elements such that the effective or apparent volume of the grinding media substantially increases and the comminuting elements or dispersed apart substantially throughout the process mixture. Typically, the angular velocity of agitator 12 is in the range of 100–400 rpm. The movement of comminuting elements 18 can be generally described as a drift of the elements in a circular direction, superimposed on which is an at least partially random motion of the comminuting elements such that they impinge on each other in a manner somewhat analogous to the accepted theory describing the movement of molecules in an ideal gas.

As the agitation of the comminuting media continues, the comminuting elements 18 continually interact with each other to affect comminution of the process mixture. The randomly moving comminuting elements 18 tend to collide with each other and with agitator arms 16 such that the comminuting elements impinge on and comminute the process mixture. The degree of agitation of the comminuting media determines the effectiveness of the agitated-media mill in comminuting the mixture. The activation of the comminuting media is dependent on a number of factors including: the vertical depth of the unagitated media; the specific gravity and viscosity of the mixture of its components; the angular velocity of the agitator shaft; the size distribution and geometric shape of the comminuting elements; and the initial particle size of the solid material in the process mixture. Furthermore, these various parameters are interrelated. For example, the preferred vertical depth of the unagitated media is dependent on the size of the comminuting elements, the rated angular velocity of the agitator shaft, the difference between the specific gravity of the comminuting elements and the process mixture, the length of the agitator arms, and the size of the comminuting vessel.

It is believed that baffle member 20*a* causes further comminution of the mixture by increasing the degree of randomness in the action of the comminution media. As specifically shown in FIG. 2, comminuting elements 18 have a generally circular drift in the direction of the rotation of agitator arms 16. Baffle members 20*a* are disposed transversely to the rotational flow of the mixture and the drift of comminution elements 18 such that comminution elements 18 located at the radially outermost regions of the mixture impact with redirecting face 22 of baffle members 20*a* and are redirected in a motion having a substantial radial component. The redirection of the comminuting elements 18 thus increases the random action that is superimposed on their generally circular drift. Furthermore, comminuting elements 18 that impact with baffle member 20*a* and are thus redirected have secondary collisions with other comminuting elements 18 and thus further develop the random nature of the agitation of the grinding media. Accordingly, the comminuting capacity of the agitated media which, intuitively, is related to the degree of random agitation of the media, is increased.

The particles of the process mixture can be relatively hard (e.g. iron oxide), brittle (e.g. coal), or soft (e.g. clay). The initial particle size of the process mixture particles is not critical and typically, may vary in the range of less than 325 mesh to greater than ¼ inch (6.35 mm) diameter. As previously mentioned, some process mixtures are comprised of solid particles in a suspension liquid and some process mixtures are comprised of particulate solids alone.

It has been found that, for certain process mixtures, the disturbances applied to the boundary layer by the surface friction of the inner wall of vessel 10 are sufficient to establish turbulent flow in which secondary irregular motions and velocity fluctuations are superimposed on the average direction of fluid flow. For such process mixtures, their exists a drag force on the mixture at the surface of the inner wall of vessel 10 that opposes movement of the mixture relative to the surface and is caused by the friction between the mixture and the inner wall surface. This drag force or opposing force is such that substantial relative motion is established between agitator arms 16 and comminution elements 18 and there is sufficient agitation of the comminuting elements to cause comminution of the process mixture.

However, certain other process mixtures or, under certain conditions, even the same mixtures tend to rotate as a solid mass together with agitator arms 16 at the angular velocity of agitator shaft 14 such that substantially no relative motion is established between agitator arms 16 and comminution elements 18 and there is no agitation of comminuting elements 18 that results in a substantial comminution of the mixture. Examples of such materials include graphite, magnesium, silver, calcium carbonate and tungsten carbide. It is believed that, for certain applications, the rotation of the process mixture as a solid body together with the angular rotation of agitator arms 16 is due to a characteristic laminar flow property in the boundary layer of the process mixture adjacent the surface of comminuting vessel 10. Apparently, laminar flow develops in the boundary layer where the surface friction between the inner wall of vessel 10 and the process mixture is sufficiently low. Under these conditions, the mixture in the boundary layer flows in concentric layers with no substantial interaction due to transfer of fluid masses between adjacent layers such that the mixture behaves as solid body that rotates with agitator 12.

Where the surface friction between the inner wall of vessel 10 and the process mixture is sufficiently low that laminar flow conditions exist such that the process mixture tends to rotate as a solid body with agitator 12, baffle member 20 of the presently disclosed invention establishes sufficient turbulence in the boundary layer such that secondary irregular motions and velocity fluctuations are superimposed on the average direction of fluid flow. Generally, baffle members 20 establish turbulent flow in the boundary layer of the mixture by establishing a radial pressure gradient in the boundary layer. Providing sufficient turbulence in the boundary layer of the mixture establishes a force that opposes the flow of the mixture and that is adequate to cause relative rotation between comminuting elements 18 and agitator arm 16 such that comminution of the mixture will occur. Consequently, the opposing force applied against the solid body rotation of the process mixture is adequate to initiate and sustain relative motion between agitator arms 16 and the comminuting elements 18 such that the comminuting media is agitated to comminute the mixture.

The angular relation of the vertically adjacent agitator arms tends to produce an upwardly directed vertical force in the mixture at a radial position near the distal ends of agitator arms 16. This vertical force tends to create an upward current in the mixture that circulates radially inwardly at the free surface of the mixture, vertically downward at the center of the mixture, and then radially outward near the bottom boundary of the mixture. Thus, the angular relation of vertically adjacent agitator arms tends to aid in the distribution of both the process mixture and the comminuting elements 18 throughout the comminuting vessel 10.

As further shown in FIGS. 1 and 2, baffle members **20*a* include streamlining faces 24 such that the baffle members have a cross-sectional shape that occupies volumes of comminuting vessel 10 where the potential would otherwise exist for low flow rates in the process mixture. Accordingly, baffle member 20*a* has redirecting and streamlining faces 22 and 24 such that baffle 20*a* extends radially into comminuting vessel 10 and circumferentially along the inner wall of vessel 10 such that the flow of the mixture tends to aid in the complete comminution of the process mixture and to retard accumulation of particles on the surface of baffle 20*a* and the adjacent surfaces of the inner wall of vessel 10 during the comminuting process. This result can be achieved in a variety of ways and accordingly, baffle members 20*a* can have a variety of cross-sectional shapes, sizes, and configurations. The preferred cross-sectional shape of baffle member 20*a* is determined in accordance with a number of parameters including the viscosity of the mixture, the angular velocity of agitator 12, the size of comminuting elements 18, and the specific gravity of the mixture. In the examples of FIGS. 1 and 2, baffle member 20*a* is shown to have a cross-sectional shape in the general form of a semicircle that is slightly flaired at both ends. However, as will be apparent to those skilled in the art, a great variety of cross-sectional shapes and patterns are possible and others of these may be preferred for a particular application. Generally, all such baffle members redirect comminuting elements 18 and tend to oppose solid rotation of the comminution mixture. Furthermore the baffle members have streamlining faces such that they tend to aid in the complete comminution of the process mixture and to retard accumulation of the particulate solids on the surface of the baffle member and adjacent portions of the inner wall of vessel 10**.

Figure 3:
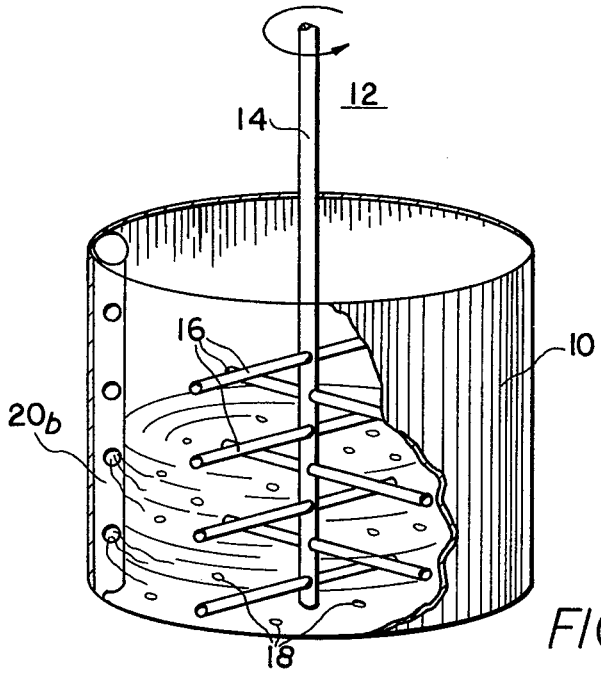
FIG. 3 shows a batch-type agitated-media comminuting mill with a portion of the vessel broken away to show a baffle member having a plurality of streamlining holes that cooperate with the mixture and the comminuting elements to aid in complete comminution of the mixture and retard accumulations of particles on the baffle and adjacent surfaces.

FIG. 3 shows a batch-type agitated-media mill similar to that of FIG. 1 in which like parts are given the same reference characters. However, the mill of FIG. 3 is provided with a perforated baffle member **20*b*. Perforated baffle 20*b* is a modification of baffle 20 of FIG. 1 in which a plurality of holes are provided transverse to the longitudinal axis of perforated baffle 20*b* and in the direction of average flow of the mixture. The holes of perforated baffle 20*b* are sufficiently large that the mixture and comminuting elements 18 can flow therethrough during the rotation of agitator arms 16. This establishes streamlines of flow through the holes, and tends to maintain flow of the mixture throughout the comminuting vessel and thereby aid complete comminution of the mixture. The flow of the mixture and comminuting elements 18 through the holes of perforated baffle 20*b* also tends to retard accumulations of solid particulates on perforated baffle 20*b* and the surface of the vessel inner wall adjacent thereto. The holes of perforated baffle 20*b* as shown in FIG. 3 are in a linear array. Alternatively, the holes can be arranged in other patterns such that the holes are grouped together at various longitudinal positions of perforated baffle 20*b* or occur over only a selected length of perforated baffle 20*b*. Preferably, the diameter of the holes is approximately three times the diameter of one of comminuting elements 18 such that comminuting elements 18** can pass freely therethrough.

Figure 6:
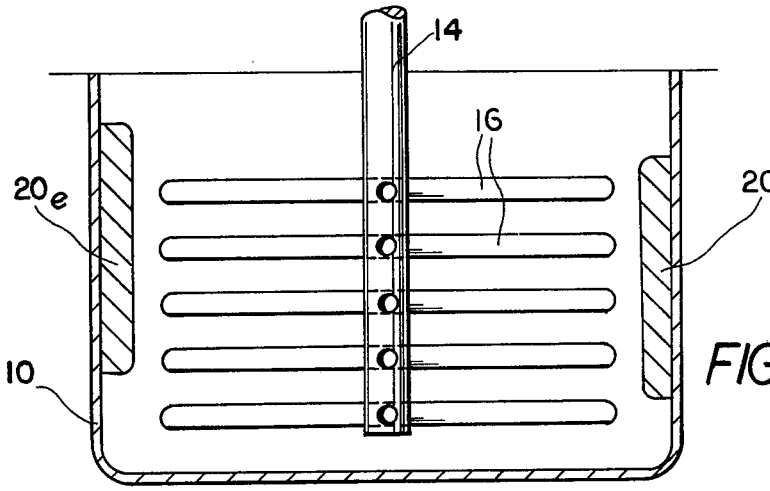
FIG. 6 shows a longitudinal section of a comminuting mill with a plurality of baffle members that are staggered with respect to each other and that extend over only a portion of the comminuting vessel.
Figure 7:
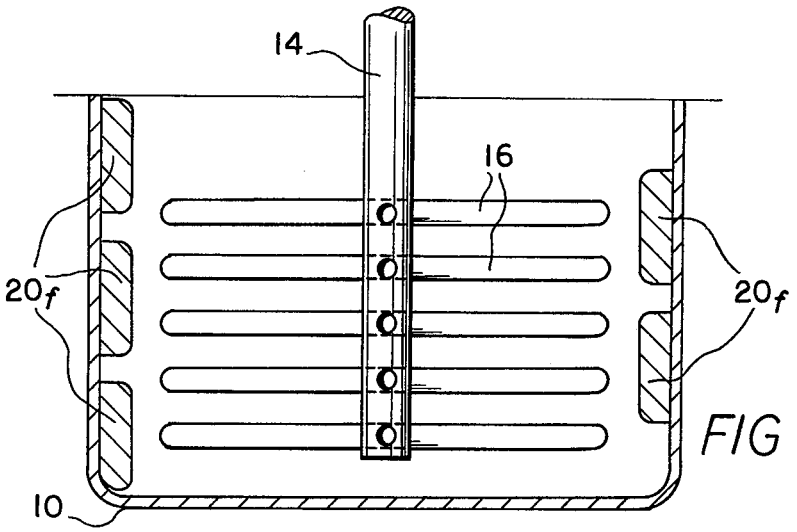
FIG. 7 shows a longitudinal section of a comminuting mill with a baffle member comprised of a plurality of linearly arranged baffle segments.
Figure 8:
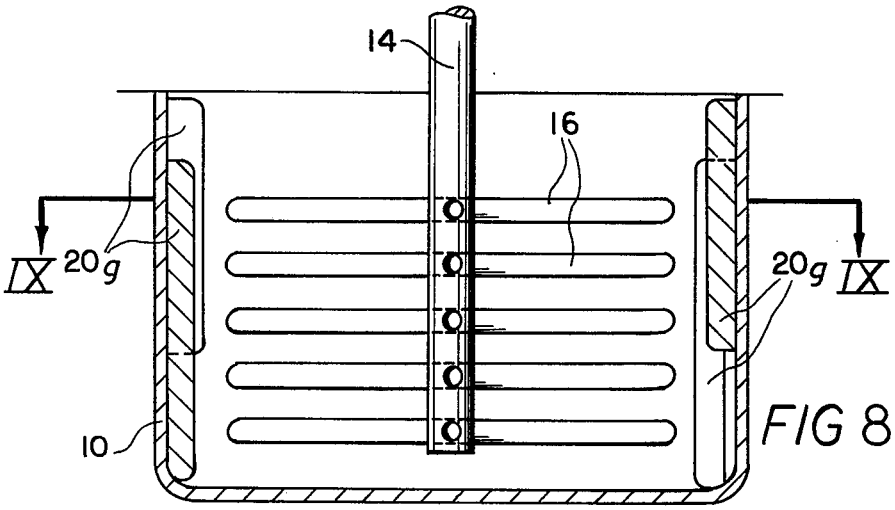
FIG. 8 shows a longitudinal section of a comminuting mill with a baffle member comprised of a plurality of laterally arranged baffle segments.
Figure 9:
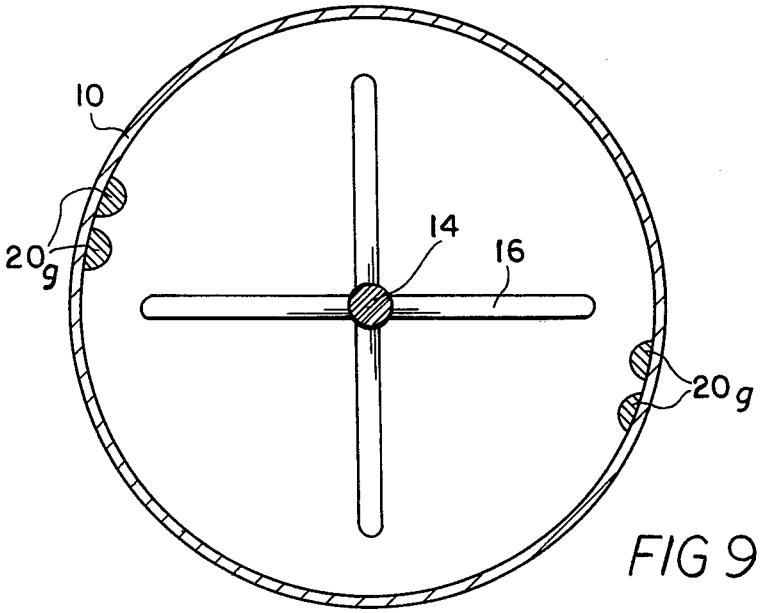
FIG. 9 shows a cross-section of the comminuting mill of FIG. 8 taken along the lines IX—IX in FIG. 8.

In addition to the examples discussed above, many other modifications of baffle member **20*a* are possible. For example, the cross-sectional area of the baffle member can vary either continuously over the length of the baffle member as shown by baffle member 20*c* in FIG. 4, or periodically over the length of the baffle member such as is shown by baffle member 20*d* in FIG. 5. As another example, as shown in FIG. 6, baffle members 20*e* are staggered with respect to each other and longitudinally extend over only a portion of the vertical dimension of comminuting vessel 10. Alternatively, baffle member 20*f* is comprised of a number of baffle segments that are linearly arranged in comminuting vessel 10 as shown in FIG. 7, or baffle member 20*g* is comprised of a number of baffle segments that are laterally arranged in comminuting vessel 10 as shown in FIGS. 8 and 9**. Various other combinations of the baffle structures suggested are also possible as well as other arrangements that are apparent from the present disclosure.

Figure 10:
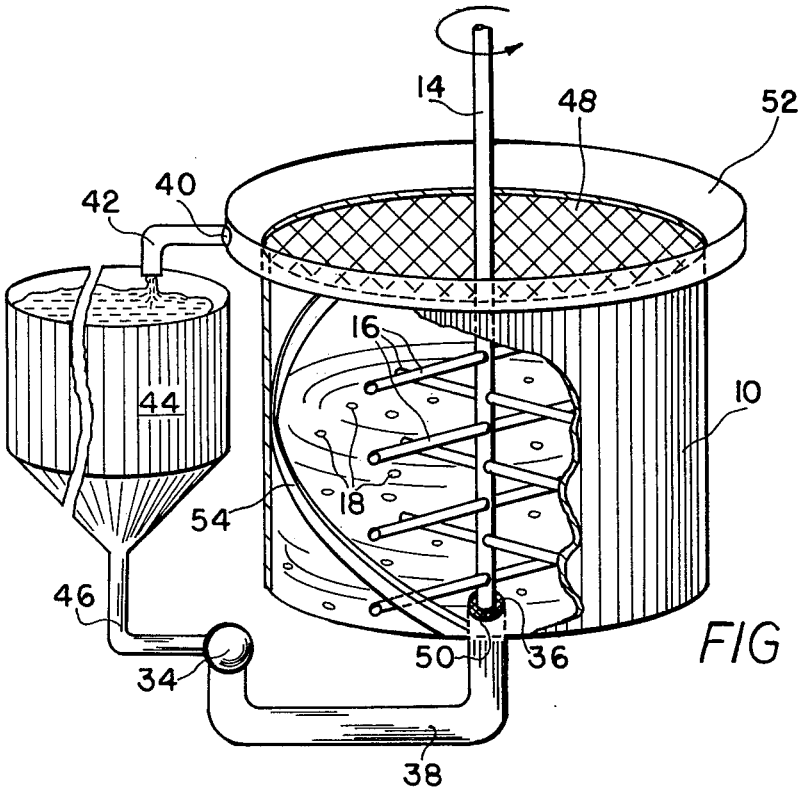
FIG. 10 is a perspective view of a circulation type comminuting system including an agitated-media mill wherein a portion of the vessel is broken away to show a helical baffle member.
Figure 4:
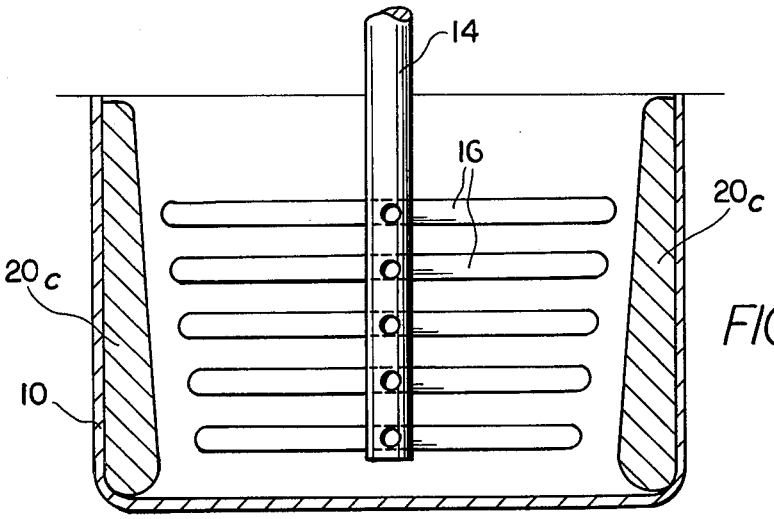
FIG. 4 shows a longitudinal section of a comminuting mill with a baffle member having a radial dimension that continously varies along the length of the baffle.
Figure 5:
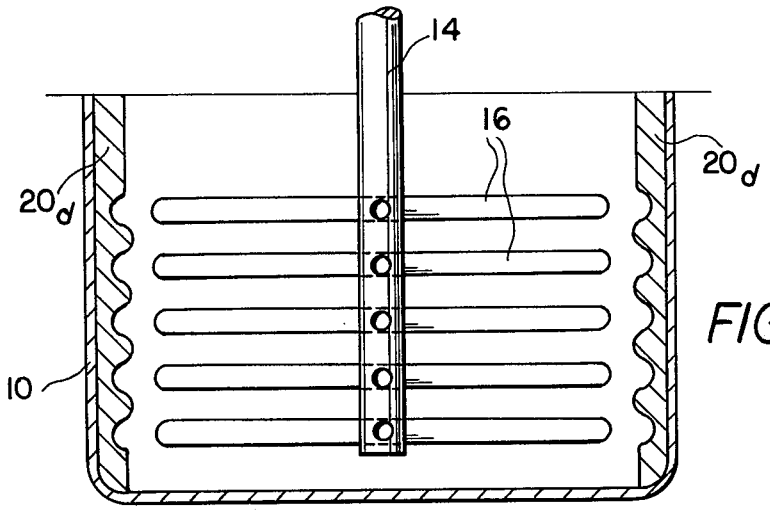
FIG. 5 shows a longitudinal section of a comminuting mill with a baffle member having a radial dimension that varies periodically along the length of the baffle.

FIG. 10 shows an agitated-media mill such as is typically used in circulation type systems. In addition to the components described with respect to FIGS. 1 and 2, the comminuting system of FIG. 10 further includes a pump 34 that is connected to input port 36 through conduit 38 and to output port 40 through conduit 42, holding tank 44 and conduit 46. Preferably, holding tank 44 is provided with a conical bottom to retard accumulation of particles in the holding tank and facilitate the flow of process mixture therethrough. Holding tank 44 may also be provided with an agitator (not shown) to maintain the solids in suspension.

Preferably, in circulation-type systems, the concentration of solids in the process mixture are 20–50% by volume and 40–65% by weight, it being found that mixtures of higher solid particle concentrations are difficult to circulate at the preferred flow rates, and lower concentrations do not provide efficient comminution. Also included is a screen 48 located at the top of comminuting vessel 10 and a screen 50 located at input port 36, the mesh size of screens 48 and 50 being large enough to permit passage of the process mixture but small enough to block passage of comminuting elements 18. Preferably, for circulation-type systems the diameter of comminuting vessel 10 is about the same dimension as its height to limit the resistance to flow of the process mixture through the comminuting vessel. Preferably, the volume of comminuting elements 18 together with agitator 12 occupy at least 5% of the volume of comminuting vessel 10 such that the volume of the agitated-media mill is no more than 95% of the volume of comminuting vessel 10. More preferably, the level of comminuting elements 18 in an unagitated state is such that less than about 5–15% of the volume of comminuting vessel 10 is free of comminuting elements 18 with the space interstitiated between the unagitated comminuting elements accounting for about 36–40% of the volume of the unagitated media. Accordingly, the volume of comminuting elements 18 in their agitated state can increase by not more than about 5–15% of the volume of the comminuting vessel.

In the operation of the agitated-media comminuting mill shown in FIG. 10, agitator shaft 14 is rotated at a rated angular velocity such that agitator arms 16 agitate the comminuting media thus causing comminuting elements 18 to comminute the mixture in a manner somewhat similar to that described with respect to FIGS. 1 and 2. However, the embodiment of FIG. 10 is a circulation-type grinding system in which the mixture is also pumped at an extremely high streaming speed vertically through comminuting vessel 10 and through the agitated media to provide certain advantages in the comminuting effectiveness. Specifically, the mixture flowing through screen 48 is passed out of comminuting vessel 10 through output port 40, and carried through conduit 42, holding tank 44, and reservoir 46 to pump 34. Pump 34 then delivers the mixture at a positive pressure through conduit 38 and input port 36 to return the mixture to the bottom of vessel 10. Preferably input port 36 is located in comminuting vessel 10 near the axis of rotation of agitator 12 to aid in the vertical flow of the process mixture upwardly through the agitated-media mill. The re-entry of the mixture thus forces additional mixture at the top of comminuting vessel 10 through screen 48 such that the cycle of vertical flow through vessel 10 is continued.

Preferably, the comminuting mill further includes a retaining chamber 52 that is separated from the comminuting vessel 10 by screen 48. It is believed that the arrangement of retaining chamber 52 in this manner aids in the recirculation of the process mixture by providing a more uniform flow of the mixture through the agitated-media mill. It has been found that the comminuted particles flow through screen 48 at a substantially constant rate and that the particles have a substantially constant and narrow size distribution.

Holding tank 44 may be a separate structure, as shown in FIG. 10, or may be integral with the agitated-media mill. Where the holding tank is integral with the agitated-media mill, the comminuting vessel may have a jacketing vessel wherein the space between the jacketing vessel and the comminuting vessel comprises the holding tank. Where a holding tank such as holding tank 44 is used, the volume of the agitated-media mill is typically several times less than the volume of the holding tank. For the example of the preferred embodiment, the volume of the agitated-media mill is about ten times less than the volume of holding tank 44. However, holding tank 44 can be of equivalent volume or even less than the volume of the agitated-media mill.

Also, in some cases, a plurality of holding tanks (not shown) can be used in combination with the agitated-media mill. In the circulation-type comminuting system, such additional holding tanks may be used for temporary storage of the mixture until it is recirculated to comminuting vessel 10 by pump 34.

Alternatively, a modified form of the agitated-media mill of FIG. 10 can be used in connection with a continuous-type comminuting system in which the process mixture is contained in a separate vessel and is pumped only a single time through the agitated media mill. In the continuous-type system, the mixture that passes through screen 48 and drawn out of output port 40 is not returned to comminuting vessel 10 but is delivered to a storage vessel.

Accordingly, agitated-media mills used in both the circulation and continuous-type comminuting systems establish a substantial forced vertical flow of the process mixture in addition to the lateral flow described with respect to FIGS. 1–9. Accordingly, comminuting vessel 10 is preferably provided with a helical baffle 54 that is transverse to the resultant flow caused by both the lateral and vertical components of flow of the process mixture. The sense of helical baffle 54 as being that of a left or right helix depends on the direction of angular rotation of agitator shaft 14. Specifically, when agitator shaft 14 is rotated in a counter-clockwise direction as viewed from top of comminuting vessel 10, helical baffle 54 is in the general form of a right helix as shown in FIG. 10. However, when the direction of rotation of agitator shaft 14 is in the clockwise direction; the sense of helical baffle 54 is that of a left helix. Accordingly helical baffle 54 is transverse to the resultant flow caused by both the horizontal and vertical components of flow of the mixture such that, in a manner similar to baffle member 20 of FIGS. 1–2 and baffle members 32*a*–32*F* of FIGS. 3–9, helical baffle 54 impacts with comminuting elements 18 located near the outer perimeter of the mixture and redirects these comminuting elements to produce additional randomness in the motion of comminuting elements 18.

Also in manner similar to baffle members 20 and 30*a*–30*f*, helical baffle 54 establishes turbulent flow conditions in the boundary layer of the process mixture. With turbulent conditions thus established, the force that opposes solid body rotation of the mixture is sufficient to produce relative movement between agitator arms 16 and the comminuting media such that comminuting elements 18 are agitated to comminute the mixture.

Furthermore, helical baffle 54 is of a transverse cross-section such that flow of the mixture adjacent baffle 54 is maintained and the accumulation of particular solids on helical baffle 54 and the adjacent inner walls of vessel 10 is retarded. The particular mechanism for maintaining mixture flow and retarding such accumulations is dependent on the particular cross-sectional geometry of the helical baffle 54 in cooperation with various other parameters of the process mixture, comminuting vessel 10, and agitator 12 as was previously stated with respect to FIGS. 1–9.

A problem that sometimes existed for circulation-type agitated-media mills was that, for certain applications and/or under certain conditions, a horizontal layer of process mixture and comminuting elements 18 would form a pressure barrier in the comminuting vessel adjacent screen 48. The vertical pressure gradient of the mixture established by this layer was high (e.g. 30 lbs per in) and, in certain circumstances, hydrostatic pressure below the barrier actually forced screen 48 off the top of comminuting vessel 10.

However, the baffles of the present invention herein disclosed have led to an unexpected improvement in the comminution of the process mixture in that they prevent formation of the horizontal layer of process mixture and comminuting elements 18 that create the vertical pressure barrier. Consequently, the baffles of the present invention improve the vertical flow of the process mixture through the agitated-media mill of circulation-type systems and eliminate the problem of screen 48 being forced off of comminuting vessel 10.

A further improvement in circulation-type comminuting systems also unexpectedly results from the improved vertical flow of the process mixture and the elimination of the pressure barrier layer provided by the baffles of the present invention. Specifically, another problem in the prior circulation-type systems was that the comminuting elements tended to contact screen 48 and cause rapid abrasion thereof. This abrasion was attributed to the existence of the pressure barrier layer with the large hydrostatic pressure below the layer tending to force comminuting elements 18 in the layer against screen 48. The surprising result of the elimination of the pressure barrier layer and the removal of the upwardly vertical hydrostatic pressure on comminuting elements in the layer in the circulation-type systems has substantially reduced the abrasion of screen 48 by comminuting elements 18 and has unexpectedly resulted in improved durability of screen 48.

A still further improvement in the durability of screen 48 is realized by the modification of the uppermost agitator arms 16*a* and 16*b* adjacent the screen as shown in FIG. 11. The agitator arms are modified such that they are ellipical in cross-section with the major axis of the ellipse being inclined with respect to a geometric plane normal to the axis of shaft 14. The agitator arms thus modified operate as baffle members 54 having redirecting faces 55 and streamling faces 56 in a manner somewhat analogus to the redirecting and steamling faces 22 and 24 of the baffles 20*a*–20*g*. The inclination of the baffles 54 with respect to the horizontal plane is in an opposite sense for agitator arms on opposite sides of shaft 14. Moreover, the sense of the inclination of baffles 54 is chosen with respect to the direction of rotation of shaft 14 such that the redirecting face 55 of both baffle 54 cooperate with the grinding elements in the path of rotation to redirect the comminuting elements 18 downwardly and away from screen 48. Stated another way, baffles 54 are inclined such that as baffles 54 alternately pass a given location in their path of rotation, they tend to repeatedly redirect comminuting elements 18 vertically downward and away from screen 48.

It will be apparent to one skilled in the art that other arrangements and orientations of baffles 54 are also possible and, in certain application, are preferred.

Baffles 54 are somewhat similar in operation to baffles 20*a*–20*g* in that they tend to increase the random action of the agitated-media by redirecting the comminuting elements. Baffles 54 also improve comminution of the mill by preventing formation of the pressure layer adjacent screen 48. In addition, baffles 54 improve the durability of screen 48 by directing comminuting elements 18 away from the screen that would otherwise tend to abrade screen 48.

In the batch-type, continuous-types, and circulation-type agitated-media mills presently disclosed herein, a plurality of baffle members such as baffles 20*a*–20*g* can be used in a single comminution mill. Such pluralities of baffle members can be circumferentially disposed about the comminuting vessel 10 in various ways. The plurality of baffles may be disposed relative to each other in a geometrically regular arrangement. For example, two baffles can be disposed at an angle of 180° about the vertical central axis of commutation vessel 10, or four baffles can be disposed at angles of 90° about the central axis of vessel 10. Alternatively, the distribution of the plurality of baffles may be geometrically irregular such as where two baffles are centered on both ends of a 60° sector of the inner wall of vessel 10.

An important consideration in the circumferential placement of the plurality of baffles about the inner wall of comminuting vessel 10 is that adjacent baffles must be separated such that the interaction of one baffle with comminuting elements 18, and the flow conditions established in the process mixture by one baffle, do not interfere with the comminuting element interactions and process mixture flow conditions established by another baffle. In this way, substantial accumulations of particulate solids do not develop on either baffle. Preferably, the circumferential placement of the baffles is such that adjacent baffles have a center-to-center displacement of at least three times the diameter of one of comminuting elements 18.

Figure 12:
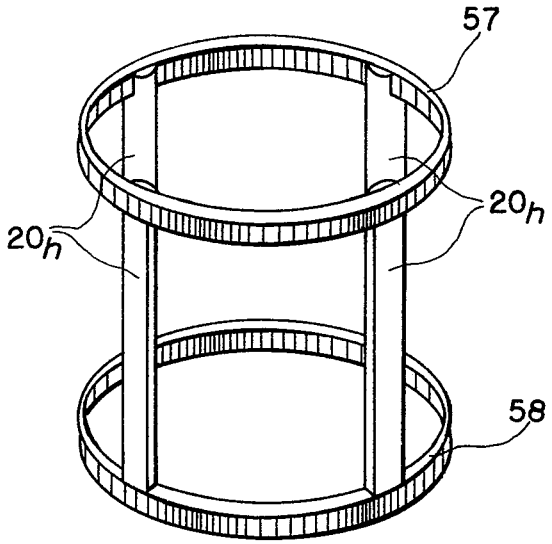
FIG. 12 shows a baffle member as a separate structure that can be detachably secured to the vessel.

Although baffles 20*a*–20*g* in FIGS. 1–10 have been described as being permanently fixed to the inner wall of comminuting vessel 10 or to screen 48, this is not essential. FIG. 12 shows a baffle structure in which a plurality of four baffles 20*h* are maintained in parallel arrangement by rings 57 and 58 attached to opposite ends of baffles 20*h*. FIG. 12 also illustrates the particular case of a plurality of baffles that are positioned in a geometrically regular arrangement with adjacent baffles being located at right angles about the center of rings 57 and 58.

The baffle structure shown in FIG. 12 is inserted into the top of comminuting vessel 10 and then fastened to the inner wall of vessel 10 by conventional fastening mechanisms such as bolting or welding as is known to those skilled in the pertinent art. The baffle structure shown in FIG. 12 has several advantages in that it can be used to modify existing agitated-media mills in accordance with the presently disclosed invention. Also it can be conveniently used in agitated-media mills that must be periodically cleaned in an extremely thorough manner as, for example, mills used in the food processing industry.

Figure 13:
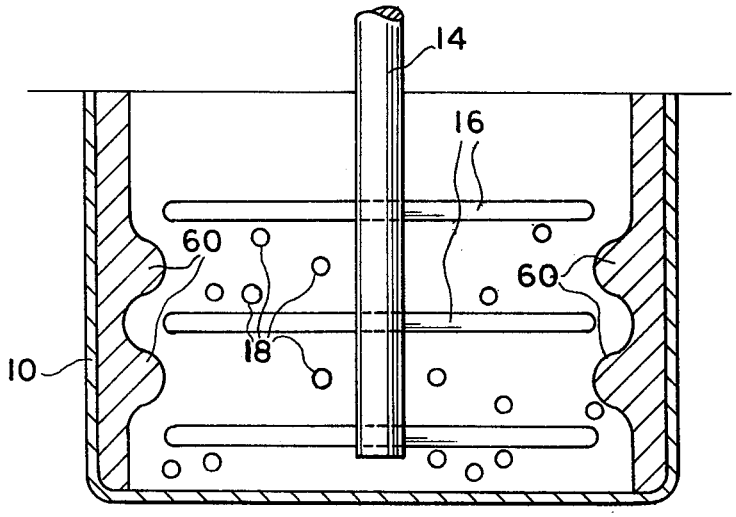
FIG. 13 shows a longitudinal section of an agitated media mill with a baffle member having a plurality of protuberances.

In the comminution of certain particulate solids, such as in the production of chocolate, the rate of flocculation of the solids, even during comminution, is so high that additional measures are preferably taken to provide further redirection of the comminuting media and greater force opposing the solid body rotation of this mixture. As shown in FIG. 13, this is accomplished in accordance with the present invention through the use of baffles having an array of protuberances. In FIG. 13, each baffle is similar to those described with respect to FIGS. 1 and 2 but is further provided with an array of protuberances 60 that protrude from the respective baffle and extend radially inward to provide additional redirection of the comminuting media and a stronger force that opposes solid body rotation of the process mixture. Accordingly, where a high degree of flocculation initially exists in the process mixture, and also as reflocculation occurs during comminution of the agitated media, the additional redirection of the comminuting media and the stronger force opposing solid body rotation of the process mixture due to the array of protuberances 60 prevents the mixture from rotating with agitator arms 16 in the manner of a solid mass.

Although protuberances 60 are shown to be arranged in a vertical linear array, arrays of inclined, or other configurations can also be used and, in certain applications, are preferred. Also, protuberances 60 can be smaller or less pronounced then shown in FIG. 13. Indeed, the less pronounced protuberances are preferred wherever the application admits to their use for the reason that the smaller protuberances are much less subject to wear by the action of the process mixture and comminuting elements 18.

As shown in the agitated-media mill of FIGS. 11 and 14, the invention of improving comminution in agitated-media comminuting mills by redirecting a portion of the comminuting elements to increase the random action of the agitated media is not limited to a specific embodiment in which a baffle member is attached to comminuting vessel 10. In the agitated-media mill of FIG. 14, comminuting elements 18 are redirected by the radial members 62 of shaft 14. Specifically, radial members 62 are provided with baffle portions 64 that have a non-circular cross-section and at least one redirecting surface 66 that is inclined with respect to the plane of rotation of radial member 62.

Redirecting surface 66 is inclined such that, during rotation of the agitator, it redirects a portion of the comminuting media to increase the random motion of the comminuting elements. Preferably, baffle portions 64 have a non-circular cross-section that is in the shape of an ellipse with the major axis of the ellipse inclined with respect to the plane of rotation of radial member 62.

Preferably, the baffle portions 64 cooperate to control the vertical flow of the process mixture through the agitated-media mill such that a pulsating or oscillating movement is super-imposed on the generally upward direction of flow. In the embodiment of FIG. 14, this is accomplished by radial members 62 that extent from opposite sides of shaft 14. In this case, the oppositely disposed radial members can be comprised of a single, circular rod with the end portion machined into baffle portions 64 and the center portion lodged in a hole bored through shaft 14. The baffle portions 64 of such oppositely disposed radial members have elliptical cross-sections with major axis in substantially the same plane. Accordingly, as the agitator 12 is rotated, the respective redirecting surfaces 66 of portions 64 tend to direct the vertical flow of the process mixture in substantially opposite vertical directions upon each revolution of the agitator. The net effect of the rotation of the agitation on the process mixture is to superimpose a pulsating or oscillating movement on the vertical flow of the process mixture. The advantage of this superimposed oscillation is that the random motion of the agitated media is increased and, therefore, the comminution of the mixture is improved.

The random motion of the agitated media can be further increased by additional modifications to the radial members 62. For example, as shown in FIG. 14, radial members 62 that are oppositely disposed on agitator shaft 14 have different radial extentions. During rotations of the agitator this structure tends to provide a radial component in the oscillation of the process mixture in the annular area between the distal portions of the respective radial members 62.

To discourage the development of a constant vertical component of flow of the process mixture, it is preferred that the inclined surfaces of vertically adjacent baffle portions 64 have an opposite sense of inclination, and that inclined surfaces 66 of baffle portions 64 having a given angular position on the shaft have the same sense of inclination. That is, it is preferred that, proceeding longitudinally along agitator shaft 14, baffle portions 64 have an alternating sense of inclination with respect to the plane of rotation of the respective radial member 62.

The present invention is further described by the following non-limiting examples.

EXAMPLE I

The embodiment of the present invention described with respect to FIGS. 1–2 was found to have a substantial improvement on the comminution of a process mixture containing Aluminum flakes. Specifically, a process mixture was prepared comprising 75% by weight of Aluminum flakes and 24.8% by weight of a solution of stearic acid and mineral spirits. Expressed in terms of volume, the mixture comprised approximately 60% by volume of Aluminum and 40% by volume of solution of stearic acid and mineral spirits.

A quantity of the process mixture was first placed in a batch-type agitated-media comminuting mill substantially similar to the mill described in connection with FIGS. 1 and 2 except that the baffles 20*a* were not present. The comminuting vessel of the mill had a mineral volume of 200 gallons. The comminuting mill was allowed to run for a period of about 5 hours during which time the process mixture rotated as a solid mass together with the agitator and the comminuting media. At the end of this period, it did not appear that any significant comminution of the process mixture had occurred and the Aluminum flakes were unsuitable for inclusion in a paint mixture.

Subsequently, baffles similar to baffles 20*a* of FIGS. 1–2 were added to the comminuting mill and a second quantity of the process mixture was added to the mill. In this case, the mill was allowed to run for approximately 5 hours. After the mill had operated for about two hours, samples of the process mixture were periodically gathered at intervals of about one-half hour. During the operation of the mill that included the baffles, the process mixture did not rotate as a solid mass. Analysis of the samples that were taken showed that, after about 2 hours of comminution in the mill, the Aluminum was in a form such that it was acceptable as a pigment in paint that did not exhibit the characteristic sheen of Aluminum. Further comminution of the mixture beyond 2 hours was found to further improve the characteristics of the Aluminum as an acceptable paint pigment.

EXAMPLE II

As another example of the substantial improvement afforded by the present invention, the presently disclosed baffles were found to effect improvement in the comminution of cocoa liquor having a high moisture content. Specifically, cocoa liquor having a moisture content of about 3% was placed in a circulation-type agitated-media comminuting mill similar to that described in relation to FIG. 10 except that no baffle members were present. The comminuting vessel had a nominal capacity of one hundred gallons and was filled with a comminuting media of 3/16 inch carbon steel balls. The comminuting mill was operated for a period of about 50–60 minutes with the agitator rotated at a rated angular velocity of 130 rpm. While drawing an electrical current of about 90 amps. At the end of this time, the mixture was comminuted such that particles in the cocoa liquor were greater than about 45 microns.

The same comminuting mill was then operated at a rated angular velocity of 142 r.p.m. while drawing an electrical current of about 80 amps. However, no significant further size reduction of the particles in the cocoa liquor was achieved. It was observed that the cocoa liquor thus processed exhibited a tendency to reflocculate. This fact, taken together with the amperage drop of the comminuting mill upon an increase in the angular velocity of the agitator suggests that further comminution of the cocoa liquor was barred by solid body rotation of the cocoa liquor together with the agitator.

Subsequently, a process mixture of cocoa liquor having a moisture content of about 3% was comminuted in a circulation-type agitated-media mill having a nominal capacity of about one gallon and filled with a comminuting media of 3/16 inch carbon steel balls. Unlike the mill described above, this comminuting mill was provided with a baffle member in accordance with the present invention. Specifically, the baffle member was somewhat similar to baffle member described in relation to FIG. 13. After the comminution process had been continued for about 45 minutes, a sample of the process mixture was taken. These showed that the size of particles in the cocoa liquor had been reduced to about 20 microns. Accordingly, substantially greater size reduction of particles in the process mixture was achieved in less time by comminution in accordance with the present invention.

While certain presently preferred embodiments of the invention have been shown and described and certain presently preferred methods of practicing the same have been illustrated, it is to be understood that the invention is not limited thereto but may be otherwise variously embodied within the scope of the following claims.

I claim:

1. Apparatus for comminuting a process mixture, said apparatus comprising:

a comminuting vessel;

a comminuting media that is contained by the comminuting vessel; and an agitator extending into the comminuting media and being rotatable therein, said agitator having a shaft with radial members extending therefrom with at least some of said radial members having surfaces that are inclined with respect to the plane of rotation of the radial member, said surfaces of radial members at a given angular position on the shaft having a sense of inclination opposite from the surfaces of adjacent radial members having the same angular position such that the rotation of said agitator causes pulsating flow of the mixture during comminution thereof.

2. The apparatus of claim 1 wherein said radial members redirect a portion of the comminuting media such that the random motion of the elements of the comminuting media is increased.

3. The apparatus of claim 2 wherein the radial member has an elliptical cross-section, the major axis of which is inclined with respect to the plane of rotation of the radial member.

4. The apparatus of claim 1 wherein the radial members extend from opposite sides of the agitator shaft.

5. The apparatus of claim 4 wherein the radial member on one side of said shaft has a shorter radial extension than the radial member on the opposite side of said shaft.

6. The apparatus of claim 5 wherein the radial member extends through a hole in said shaft.

7. The apparatus of claim 1 wherein radial members that are longitudinally adjacent on the agitator shaft are angularly disposed.

8. The apparatus of claim 1 wherein longitudinally adjacent radial members have an opposite sense of inclination with respect to the plane of rotation.

9. Apparatus for comminuting a process mixture, said apparatus comprising:

a comminuting vessel having an input port at one end and an output port at an opposite end;

a comminuting media that is contained by the comminuting vessel;

means for circulating the process mixture through the comminuting vessel from the input port to the output port;

a screen transversely arranged in the comminuting vessel at a longitudinal position between the input and output ports; and an agitator extending into the comminuting media and being rotatable therein, said agitator having a shaft with radial members extending from said shaft, said radial members adjacent said screen having a redirecting face that is inclined with respect to the plane of rotation of the radial member, the sense of inclination of said redirecting face with respect to the direction of rotation of said shaft being such that the radial member, redirects the elements of the comminuting media away from said screen.

10. The apparatus of claim 9 wherein the inclination of redirecting surfaces of radial members on opposite sides of said shaft is in the opposite sense.

* * * * *